US011247459B2

(12) United States Patent
Khusnatdinov et al.

(10) Patent No.: US 11,247,459 B2
(45) Date of Patent: Feb. 15, 2022

(54) LIQUID CHARGING APPARATUS, LIQUID CHARGING METHOD, AND MANUFACTURING METHOD

(71) Applicant: CANON KABUSHIKI KAISHA, Tokyo (JP)

(72) Inventors: Niyaz Khusnatdinov, Round Rock, TX (US); Zhengmao Ye, Austin, TX (US)

(73) Assignee: Canon Kabushiki Kaisha, Tokyo (JP)

( * ) Notice: Subject to any disclaimer, the term of this patent is extended or adjusted under 35 U.S.C. 154(b) by 93 days.

(21) Appl. No.: 16/518,754

(22) Filed: Jul. 22, 2019

(65) Prior Publication Data

US 2021/0023840 A1 Jan. 28, 2021

(51) Int. Cl.
*B41J 2/085* (2006.01)
*B41J 2/135* (2006.01)

(52) U.S. Cl.
CPC ..... *B41J 2/085* (2013.01); *B41J 2/135* (2013.01)

(58) Field of Classification Search
CPC ..... B41J 2/1632; B41J 2/1609; B41J 2/1623; B41J 2/164; B41J 2002/14258
See application file for complete search history.

(56) References Cited

U.S. PATENT DOCUMENTS 4,668,959 A * 5/1987 Jochimsen ..... B41J 2/20 347/34
4,854,506 A * 8/1989 Noakes ..... B05B 5/0255 239/691
5,221,050 A * 6/1993 Jeffries ..... B05B 5/035 239/708
5,825,383 A * 10/1998 Abe ..... B41J 2/14 347/54
7,066,582 B2 * 6/2006 Deguchi ..... B41J 2/1606 347/64
7,156,045 B2 * 1/2007 Ueno ..... B05B 5/0407 118/300
7,290,868 B2 * 11/2007 Sakamoto ..... B41J 2/1609 347/40
7,506,974 B2 * 3/2009 Hirakawa ..... B41J 2/04 347/101
7,641,316 B2 * 1/2010 Sakai ..... B41J 2/1603 347/64
7,874,659 B2 * 1/2011 Silverbrook ..... B41J 3/445 347/86
2002/0130926 A1 * 9/2002 Yamada ..... B41J 2/06 347/55
2003/0189167 A1 * 10/2003 Schultz ..... H01J 49/0018 250/281
2004/0174414 A1 * 9/2004 Tanikawa ..... B41J 2/1646 347/70
2016/0207311 A1 * 7/2016 Tamai ..... B41J 2/162
2018/0009223 A1 * 1/2018 Poulikakos ..... B41J 2/06

* cited by examiner

*Primary Examiner* — John Zimmermann
(74) *Attorney, Agent, or Firm* — Canon U.S.A., Inc., IP Division

(57) ABSTRACT

An apparatus and method configured to eject an electrically charged liquid. The apparatus and method include a liquid-ejecting apparatus including a reservoir for storing a liquid, an electrically conductive faceplate for ejecting the liquid, a plurality of channels connecting the reservoir to the electrically conductive faceplate, and a voltage source to change and maintain an electric potential difference between the liquid and the electrically conductive faceplate during ejection from the electrically conductive faceplate.

22 Claims, 6 Drawing Sheets

LIQUID CHARGING APPARATUS, LIQUID CHARGING METHOD, AND MANUFACTURING METHOD

BACKGROUND OF THE INVENTION

Field of the Invention

The present disclosure relates to nanoimprint technology including electrical charging of liquids.

Description of the Related Art

In the semiconductor fabrication field, the use of advanced semiconductor lithography is fast becoming the standard. Nanoimprint lithography techniques are known to possess remarkable replication capability with its resolution approaching molecular scale.

More specifically, in a step-and-repeat nanoimprint lithography process an imprint resist is used in the form of small volume droplets dispensed onto a substrate. Typical range of the dispensed drops is from 0.1 pL to 10 pL. In this configuration, the drops spread and merge when a template comes in contact with the resist drops and substrate during imprinting. The advantages of the resist being dispensed in small droplets rather than as a continuous film is the control of the local resist volume required for a specific area by means of changing the number of droplets dispensed in an area. The local volume requirements come from the pattern to be filled. Thus, a pattern can be located on template only, on substrate only, or on both. The patterns are typically made by an etch process that can be dry or wet etch.

For each different template/substrate pattern the distribution of the resist drops (droplets) on the substrate can be different. Each different distribution corresponds to a different resist drop pattern that need to be dispensed. Fluid resist droplets are dispensed by an inkjet type fluid dispenser that uses the resist as a dispense liquid instead of ink.

However, in these configurations liquid drops adapt a shape due to many external factors. These factors include: surface tension balance, resist viscosity, surface roughness, and electric charge of the liquid drops. For example, liquid drops of the same sign electric charge that are near each other, cause repulsion in respect to each other. Thus, liquid drop spread and distribution on a substrate depends on the electric charge of the droplets.

SUMMARY OF THE INVENTION

The various embodiments of the present liquid-ejecting apparatus and method, have several features, no single one of which is solely responsible for their desirable attributes. Without limiting the scope of the present embodiments as expressed by the claims that follow, their more prominent features now will be discussed briefly. After considering this discussion, and particularly after reading the section entitled "Detailed Description of the Embodiments," one will understand how the features of the present embodiments provide the advantages described herein.

In a first embodiment, a liquid-ejecting apparatus includes a reservoir for storing a liquid, an electrically conductive faceplate for ejecting the liquid, a plurality of channels connecting the reservoir to the electrically conductive faceplate, and a voltage source to change and maintain an electric potential difference between the liquid and the electrically conductive faceplate during ejection from the electrically conductive faceplate.

In another embodiment, a method for controlling a liquid-ejecting apparatus includes, storing a liquid in a reservoir, moving the liquid from the reservoir to an electrically conductive faceplate through a plurality of channels connecting the reservoir to the electrically conductive faceplate, changing and maintaining an electric potential difference, via a voltage source, between the liquid and the electrically conductive faceplate, and ejecting, from the electrically conductive faceplate, the liquid with the electric potential difference applied.

DETAILED DESCRIPTION OF THE EMBODIMENTS

Example devices, methods and systems are described herein. Any example embodiment or feature described herein is not necessarily to be construed as preferred or advantageous over other embodiments or features. The example embodiments described herein are not meant to be limiting. It will be readily understood that certain aspects of the disclosed systems and methods can be arranged and combined in a wide variety of different configurations, all of which are contemplated herein.

Furthermore, the particular arrangements shown in the figures should not be viewed as limiting. It should be understood that other embodiments might include more or less of each element shown in a given figure. Further, some of the illustrated elements may be combined or omitted. Yet further, an example embodiment may include elements that are not illustrated in the figures.

Because there is a need to control an electric charge of ejected liquid from a faceplate, exemplary embodiments of the present disclosure provide for electrically controlling a charge of an ejected liquid droplet by electrically charging and maintaining an electrical potential difference of a liquid stored in a reservoir during ejection. This improves the distribution of the ejected liquid dispensed on a substrate.

Figure 1:
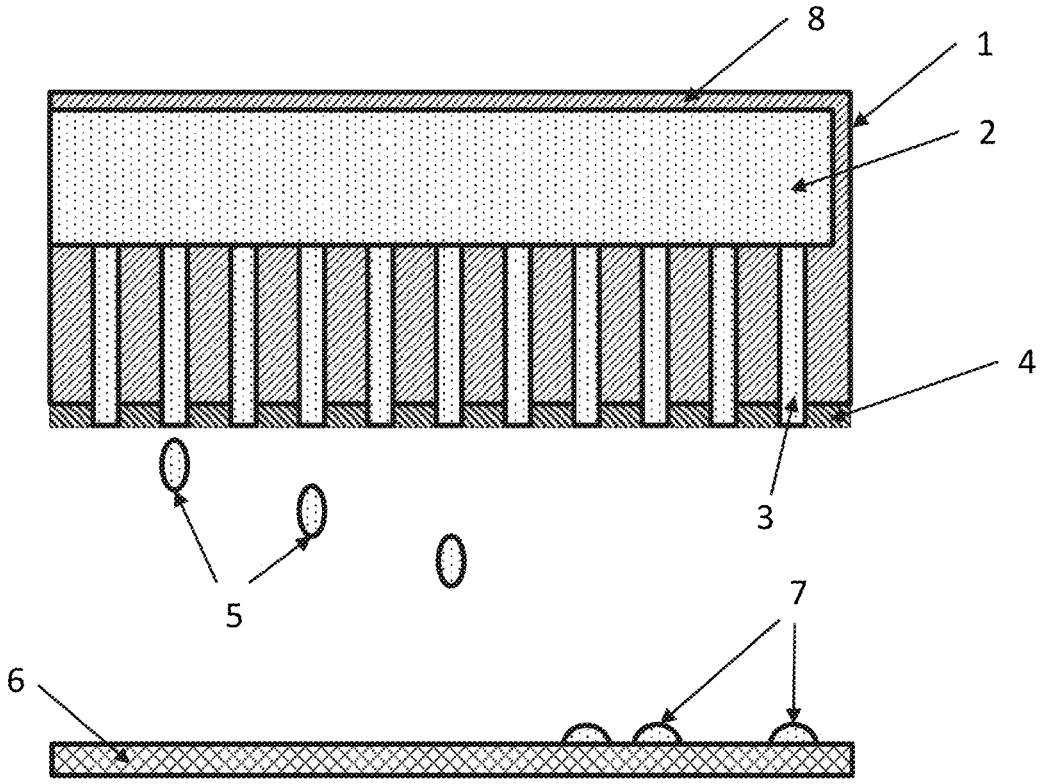
FIG. 1 depicts a liquid-ejecting system according to an exemplary embodiment of the present disclosure.

FIG. 1 depicts a liquid-ejecting system according to an exemplary embodiment of the present disclosure. The liquid-ejecting system includes, but is not limited to, a fluid dispenser 1, a liquid 2 to be ejected, a reservoir 8, a plurality of liquid channels 3, a faceplate 4 with channel openings, a plurality of liquid droplets 5, a control unit to control the operation of fluid dispenser 1, a substrate 6, and applied liquid droplets 7.

Fluid dispenser 1, moves a liquid 2 to be ejected from the reservoir 8 where the liquid 2 is temporarily stored, through a plurality of liquid channels 3 to the faceplate 4 with channel openings at the edge of the fluid dispenser 1. Examples of the liquid 2 stored in the reservoir 8 can be, but is not limited to, a liquid resist, a formable material, or a curable composition. Upon reaching the faceplate 4, the liquid 2 in the plurality of liquid channels 3 is ejected with a specific electric charge which originates from a double charged layer naturally existing between the liquid and the faceplate material. This is similar to the triboelectric effect where dynamic friction and charge separation from an electrical double layer leads to electrization of both participating bodies. This explains the electric charge of the plurality of liquid droplets 5 ejected from the faceplate 4.

Due to the electric charges of the plurality of liquid droplets 5, the electric charge of an applied liquid droplet 7 on a positionally-adjacent applied liquid droplet 7 affects the drop spreading onto the substrate 6. Moreover, the spreading of the applied liquid droplets 7 onto the substrate 6 is also contingent on surface tension balance of the substrate 6 and the applied liquid droplets 7, the viscosity of liquid 2 and/or surface roughness of substrate 6. Thus, controlling the electric charge of the plurality of liquid droplets 5 ejected from the faceplate 4 controls the spreading of the applied liquid droplets 7 on the substrate 6.

Figure 2:
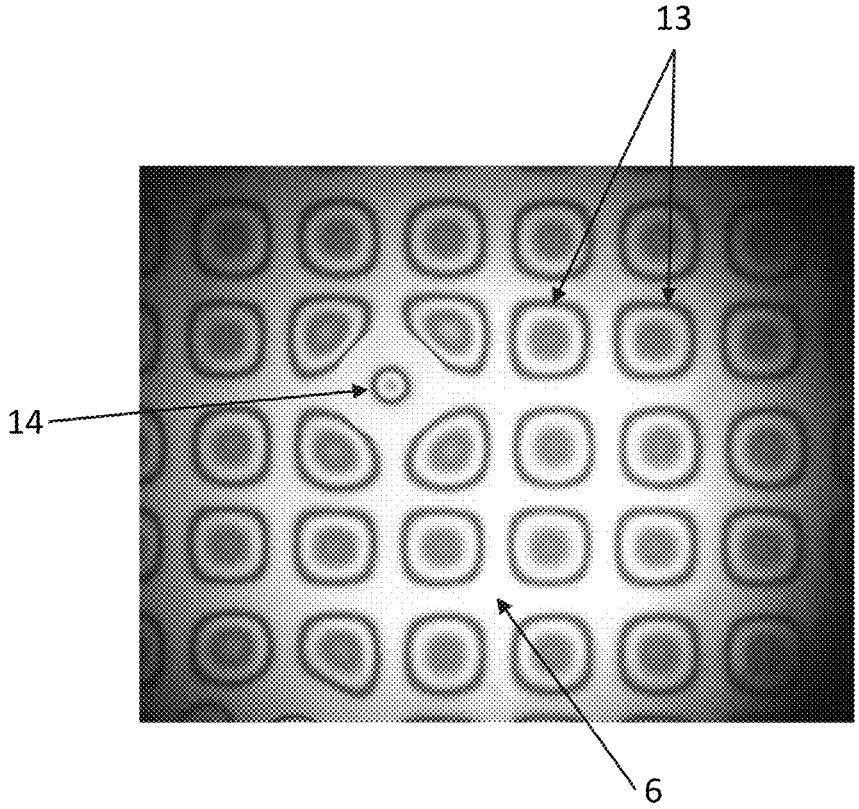
FIG. 2 is a plan view of a substrate showing the effects of an electric charge of an applied liquid droplet according to an exemplary embodiment of the present disclosure.

FIG. 2 is a plan view of a substrate showing the effects of an electric charge of an applied liquid droplet according to an exemplary embodiment of the present disclosure.

In this embodiment, the applied liquid droplets 13 are of a liquid resist and the majority applied on the substrate 6 are square in shape. This is due to factors acting upon the applied liquid droplets 13, wetting and electrostatic repulsion. The electrostatic repulsion prevents drops from moving closer to each other. Thus, the electric charge of each resist drops prevents the applied liquid droplets 13 from merging.

However, applied liquid droplet 14 on substrate 6 is a liquid resist droplet with a significantly higher electric charge than the surrounding droplets. As such, applied liquid droplet 14 is prevented from spreading and retains its round shape after being applied to substrate 6. Moreover, the electric charge of applied liquid droplet 14 limits the spreading of surrounding applied droplets 13 as well.

Figure 3:
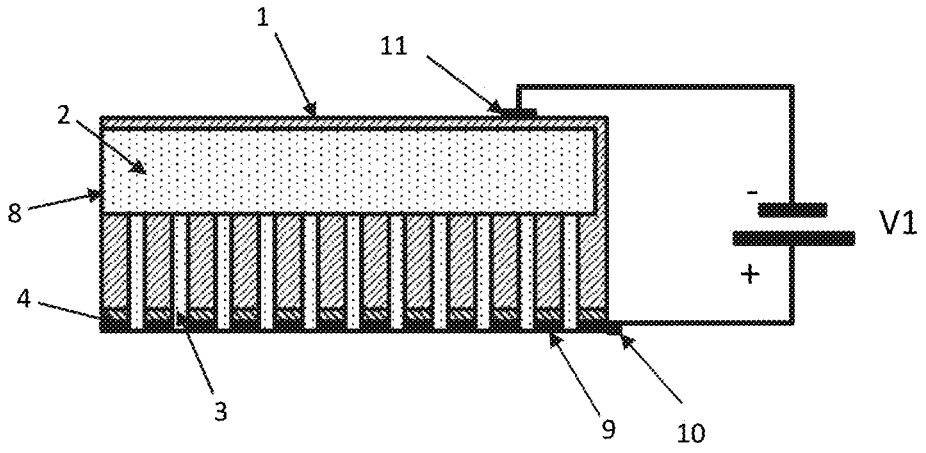
FIG. 3 is a plan view of a liquid-ejecting system with an electric charge potential control circuit according to a first embodiment of the present disclosure

FIG. 3 is a plan view of a liquid-ejecting system with an electric charge potential control circuit according to a first embodiment of the present disclosure. In this embodiment, individual components are mostly similar to the embodiment described in FIG. 1 except a new electrically conductive layer 9 deposited on the faceplate 4, a voltage source V1, a connector 10 and a connector 11.

Voltage source V1 can be, but is not limited to, a DC voltage supply and is controlled by a control unit. Voltage source V1 has two terminals with opposing polarities for connection to the fluid ejecting system. Conductive layer 9 can be, but is not limited to, a coating applied to commonly non-conductive faceplate 4. Conductive layer 9 is able to conduct an electric current applied by voltage source V1 and to apply required electric potential with respect to the liquid 2. In another embodiment conductive layer 9 can be applied to the sidewalls of the plurality of liquid channels 3 to also provide an electric potential difference applied by voltage source V1 to the interface between liquid 2 and the conductive layer 9 while in the plurality of liquid channels 3. Moreover, conductive layer 9 has a connector 10 that is connected to a terminal of voltage source V1 to carry an electric current from voltage source V1 to define required electric potential in the conductive layer 9. In another embodiment, the electric current from voltage source V1 is carried to the plurality of liquid channels 3 that are in contact with conductive layer 9 to establish a required electric potential difference in the interface between the conductive layer 9 and the liquid 2.

In this embodiment, connector 11 is connected to fluid dispenser 1 and to the opposing terminal of voltage source V1 not connected to connector 10. This connection carries an electric current from voltage source V1 to define potential difference between the liquid 2 and conductive layer 9. Additionally, connector 11 may share a common ground with fluid dispenser 1.

In this configuration, voltage source V1 is able to control the electric potential difference between liquid 2 to be ejected from the plurality of liquid channels 3 and conductive layer 9. Moreover, the control unit controls voltage source V1 to apply a necessary voltage to achieve specific electric charges of the liquid droplets 7 to achieve corresponding spreading characteristics of the applied liquid droplets 7 on the substrate 6. This can be done by, but is not limited to, controlling and changing the electric potential difference between the liquid in the plurality of channels 3 and conductive layer 9 during multiple ejection applications.

Figure 4:
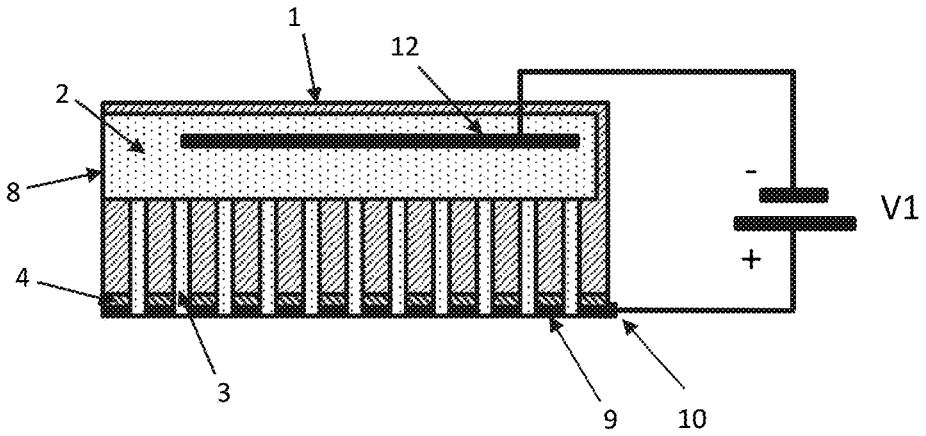
FIG. 4 is a plan view of a liquid-ejecting system with an electric charge potential control circuit according to a second embodiment of the present disclosure.

FIG. 4 is a plan view of a liquid-ejecting system with an electric potential difference control circuit according to a second embodiment of the present disclosure. In this embodiment, individual components are similar to the embodiment described FIG. 3. As such, detailed descriptions of each and their respective operations are omitted. In this embodiment, there is an electrode 12 positioned in the reservoir 8 in contact with the liquid 2.

As mentioned above, conductive layer 9 has a connector 10 connected to a terminal of voltage source V1 to carry an electric current from voltage source V1 throughout the conductive layer 9. In another embodiment conductive layer 9 can be applied to the sidewalls of the plurality of liquid channels 3 and the electric current from voltage source V1 is carried to the conductive layer 9 on sidewalls of the plurality of liquid channels 3.

In this embodiment, electrode 12 is connected to the opposing terminal of voltage source V1 not connected to connector 10. This allows an electric current to flow from voltage source V1 to electrode 12. Thus, voltage source V1 is able to control the electric potential difference between liquid 2 to be ejected and conductive layer 9.

Figure 5:
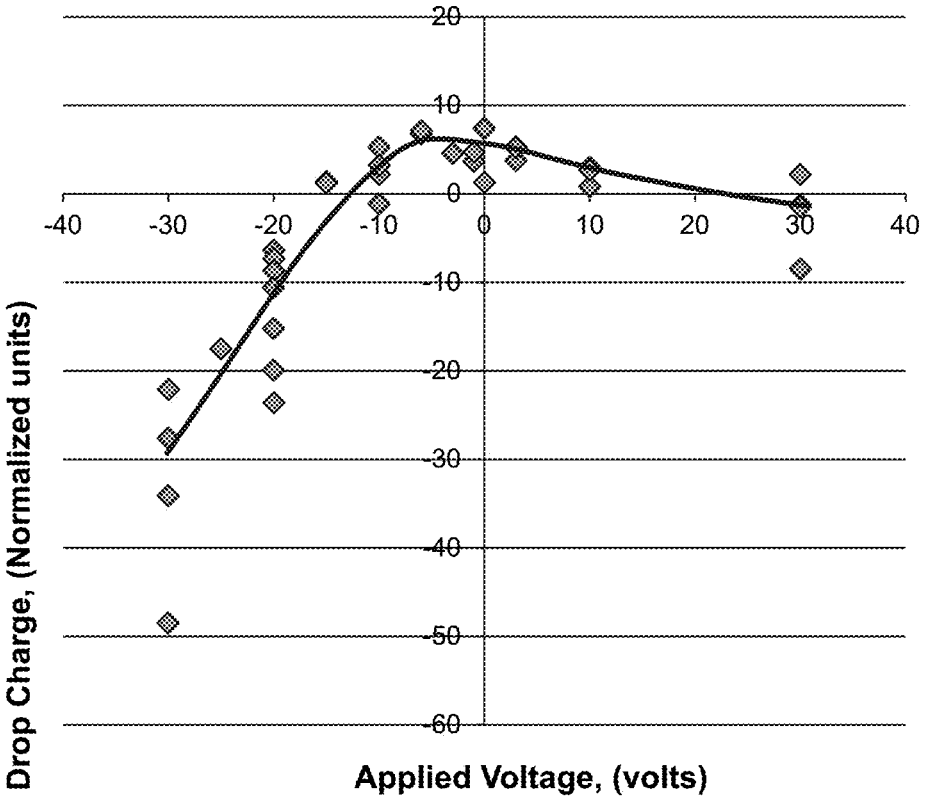
FIG. 5 is a graph showing an example of dependence of electric charge of a liquid droplet on voltage applied to a fluid dispenser according to an exemplary embodiment of the present disclosure.

Accordingly, the control unit controls voltage source V1 to apply a necessary voltage to achieve specific electric charges of the applied liquid droplets 7 according to FIG. 5, to achieve required spreading characteristics and application results. This can be done by, but is not limited to, controlling and changing the electric potential difference between liquid 2 in the plurality of liquid channels 3 and conductive layer 9 during multiple ejection applications.

FIG. 5 is a graph showing an example of experimentally determined dependence of electric charge of a liquid droplet on voltage applied to the fluid dispenser 1 according to an exemplary embodiment of the present disclosure.

In this exemplary embodiment the liquid is an imprint resist and voltage is measured in volts with values in the range from −30V to +30V.

Figure 6:
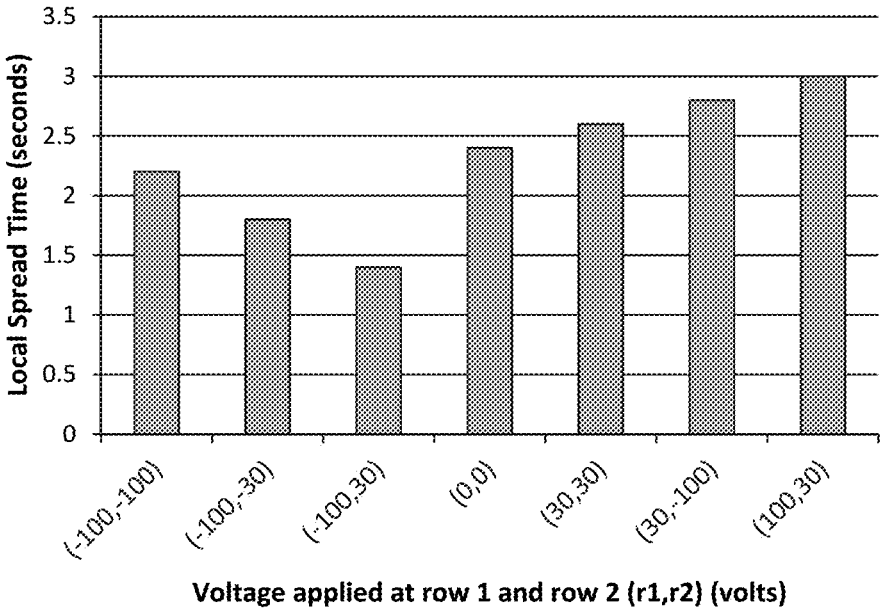
FIG. 6 is a graph of liquid droplet spread time due to applied voltage according to an exemplary embodiment of the present disclosure.

FIG. 6 is a graph of liquid droplet local spread time due to applied voltage according to an exemplary embodiment of the present disclosure. Local spreading is defined by droplet merge observation within the field of view of a 5× microscope.

In this exemplary embodiment, the liquid 2 is a liquid resist and the fluid dispenser 1 has two separate arrays of channels 3 with two separate faceplates, positionally-adjacent to one another to eject the liquid resist stored in a reservoir 8 from faceplates 4. Here, each of the liquid channels 3 terminates with a nozzle at a faceplate 4 for ejection.

Accordingly, the first nozzle array ejecting the liquid 2 as applied liquid droplets 7 on a substrate 6 will be referred to as r1 and the second nozzle array ejecting the liquid 2 to as applied liquid droplets 7 on a substrate 6 will be referred to as r2. In the graph as shown, different voltages were applied to r1 and r2 to find an optimal electric charge combination for liquid droplets to reduce spread time of the applied liquid droplets 7. In some cases the voltages at r1 and r2 were of opposite signs to effectively determine effects of electrostatic attraction of r1 on r2 and vice versa.

In this example, different voltages are applied to r1 and r2 and the time interval is measured from the time drops are dispensed until the moment when the drops form a continuous film after being applied on a substrate 6. As shown, as the applied voltage to r1 becomes more negative the time interval reduces. The time interval of the drop spreading is also sensitive to the variations of the voltage applied to r2. From the results the voltages −100 V applied to r1 and 30 V applied to r2 (−100,30) achieves the least local spread time when applied to substrate 6. Therefore, the dependence of local resist spread time when applied to a substrate 6 is a function of the applied voltages to both rows and the right combination of voltages can reduce the spread time significantly.

Lastly, a manufacturing method of a device (a semiconductor device, a magnetic storage media, a liquid crystal display element, or the like) serving as an article will be described. The manufacturing method includes a step of forming a pattern on a substrate (a wafer, a glass plate, a film-like substrate, or the like) using a liquid-ejecting apparatus or liquid-ejecting method described above. The manufacturing method further includes a step of processing the substrate on which the pattern has been formed. The processing step can include a step of removing the residual film of the pattern. The processing step can also include another known step such as a step of etching the substrate using the pattern as a mask. The method of manufacturing the article according to this embodiment is superior to a conventional method in at least one of the performance, quality, productivity, and production cost of the article.

While the present disclosure has been described with reference to exemplary embodiments, it is to be understood that the invention is not limited to the disclosed exemplary embodiments. The scope of the following claims is to be accorded the broadest interpretation to encompass all modifications, equivalent structures and functions.

What is claimed is:

1. A liquid-ejecting apparatus comprising:

a reservoir for storing a liquid;

an electrically conductive faceplate for ejecting the liquid;

a plurality of channels connecting the reservoir to the electrically conductive faceplate;

a dispenser for moving the liquid from the reservoir through the plurality of channels to the electrically conductive faceplate and for ejecting the liquid from the faceplate; and a voltage source, separate from the dispenser, to change and maintain an electric potential difference between the liquid and the electrically conductive faceplate during ejection from the electrically conductive faceplate, wherein the electric potential difference changed and maintained by the voltage source is based on a predetermined spreading characteristic.

2. The liquid-ejecting apparatus according to claim 1, wherein the liquid at the electrically conductive faceplate is ejected as a plurality of droplets, and wherein each of the plurality of droplets, is ejected onto a substrate at a location positionally-adjacent to a previously ejected droplet of different electric potential.

3. The liquid-ejecting apparatus according to claim 1, further comprising:

a first electrode with a first end positioned in the reservoir and a second end connected to a first terminal of the voltage source; and a second electrode with a first end connected to a second terminal of the voltage source and a second end connected to the electrically conductive faceplate.

4. The liquid-ejecting apparatus according to claim 1, further comprising:

an electrically conductive housing storing the reservoir;

a first electrode with a first end connected to a first terminal of the voltage source and a second end connected to the electrically conductive housing; and a second electrode with a first end connected to a second terminal of the voltage source and a second end connected to the electrically conductive faceplate.

5. The liquid-ejecting apparatus according to claim 1, further comprising:

a first electrode with a first end positioned in the reservoir and a second end connected to a first terminal of the voltage source; and a second electrode with a first end connected to a second terminal of the voltage source and a second end connected to the plurality of channels, wherein the plurality of channels include electrically conductive sidewalls.

6. The liquid-ejecting apparatus according to claim 1, further comprising:

an electrically conductive housing storing the reservoir;

a first electrode with a first end connected to a first terminal of the voltage source and a second end connected to the electrically conductive housing; and a second electrode with a first end connected to a second terminal of the voltage source and a second end connected to the plurality of channels, wherein the plurality of channels include electrically conductive sidewalls.

7. The liquid-ejecting apparatus according to claim 1, wherein the voltage source provides varying electric potential differences to an electrically conductive opening at each of the plurality of channels based on a predetermined value, upon ejection of the liquid.

8. The liquid-ejecting apparatus according to claim 7, wherein the predetermined value for providing the electric potential difference to the electrically conductive opening at each of the plurality of channels is based on the electric potential difference provided to a positionally-adjacent electrically conductive opening.

9. A method for controlling a liquid-ejecting apparatus comprising:

storing a liquid in a reservoir;

moving, via a dispenser, the liquid from the reservoir to an electrically conductive faceplate through a plurality of channels connecting the reservoir to the electrically conductive faceplate;

changing and maintaining an electric potential difference, via a voltage source separate from the dispenser, between the liquid and the electrically conductive faceplate; and ejecting, from the electrically conductive faceplate, the liquid with the electric potential difference applied, wherein the electric potential difference changed and maintained by the voltage source is based on a predetermined spreading characteristic.

10. The method according to claim 9, wherein the ejected liquid at the electrically conductive faceplate ejects as a plurality of droplets, and wherein each of the plurality of droplets, is ejected onto a substrate at a location positionally-adjacent to a previously ejected droplet of different electric potential.

11. The method according to claim 9, further comprising:

connecting a first electrode with a first end positioned in the reservoir and a second end connected to a first terminal of the voltage source; and connecting a second electrode with a first end connected to the second terminal of the voltage source and a second end connected to the faceplate.

12. The method according to claim 9, further comprising:

storing the reservoir in an electrically conductive housing;

connecting a first electrode with a first end connected to a first terminal of the voltage source and a second end connected to the electrically conductive housing; and connecting a second electrode with a first end connected to a second terminal of the voltage source and a second end connected to the electrically conductive faceplate.

13. The method according to claim 9, further comprising:

connecting a first electrode with a first end positioned in the reservoir and a second end connected to a first terminal of the voltage source; and connecting a second electrode with a first end connected to a second terminal of the voltage source and a second end connected to the plurality of channels, wherein the plurality of channels include electrically conductive sidewalls.

14. The method according to claim 9, further comprising:

storing the reservoir in an electrically conductive housing;

connecting a first electrode with a first end connected to a first terminal of the voltage source and a second end connected to the electrically conductive housing; and connecting a second electrode with a first end connected to a second terminal of the voltage source and a second end connected to the plurality of channels, wherein the plurality of channels include electrically conductive sidewalls.

15. The method according to according to claim 9, wherein the voltage source applies varying electric potential differences to an electrically conductive opening at each of the plurality of channels based on a predetermined value upon ejecting the liquid.

16. The method according to claim 15, wherein the predetermined value for applying the electric potential difference to the electrically conductive opening at each of the plurality of channels is based on the electric potential difference applied to a positionally-adjacent electrically conductive opening.

17. A method of manufacturing an article, the method comprising:

applying a formable material on a substrate while controlling a liquid-ejecting apparatus using a control method according to claim 9;

curing the formable material to form a cured layer on the substrate; and processing the substrate on which the cured layer has been formed.

18. The method for controlling a liquid-ejecting apparatus according to claim 9, wherein the liquid is a resist.

19. The method for controlling a liquid-ejecting apparatus according to claim 9, wherein the liquid is ejected onto a substrate in a predetermined pattern.

20. The liquid-ejecting apparatus according to claim 1, further comprising:

an additional electrically conductive faceplate for ejecting the liquid, an additional plurality of channels connecting the reservoir to the additional electrically conductive faceplate, wherein each channel of the plurality of channels terminates with a nozzle at the electrically conductive faceplate forming a first nozzle array, and wherein each channel of the additional plurality of channels terminates with a nozzle at the additional electrically conductive faceplate forming a second nozzle array.

21. The liquid-ejecting apparatus according to claim 20, wherein the voltage source is configured to apply a first voltage to the first nozzle array and a second voltage to the second nozzle array, and wherein the first voltage is different from the second voltage.

22. The liquid-ejecting apparatus according to claim 21, wherein the first voltage is positive and the second voltage negative.

* * * * *